US005634785A

United States Patent [19]

Bury et al.

[11] Patent Number: 5,634,785

[45] Date of Patent: Jun. 3, 1997

[54] GAS BURNER WITH VERY SMALL NITROGEN OXIDE EMISSION

[75] Inventors: Frederic Bury, Allauch; Jean-Claude Gauthier, Marseille, both of France

[73] Assignee: Entreprise Generale de Chauffage Industriel Pillard, Cedex 8, France

[21] Appl. No.: 407,286

[22] Filed: Mar. 20, 1995

[30] Foreign Application Priority Data

Mar. 29, 1994 [FR] France ..... 94 04136

[51] Int. Cl.[6] ..... F23L 4/00; F23C 7/00

[52] U.S. Cl. ..... 431/9; 431/116; 431/284; 431/285

[58] Field of Search ..... 431/115, 116, 431/8, 9, 282, 285, 284, 278

[56] References Cited

U.S. PATENT DOCUMENTS

| | | | |
|---|---|---|---|
| 3,033,273 | 5/1962 | Zink et al. | 431/285 X |
| 3,985,494 | 10/1976 | Childree | 431/285 X |
| 5,073,105 | 12/1991 | Martin et al. | 431/116 |
| 5,135,387 | 8/1992 | Martin et al. . | |
| 5,238,395 | 8/1993 | Schwartz et al. . | |
| 5,269,678 | 12/1993 | Schwartz et al. | 431/116 X |
| 5,284,438 | 2/1994 | McGill | 431/116 X |

FOREIGN PATENT DOCUMENTS 0 511 878 11/1992 European Pat. Off. .

*Primary Examiner*—Carl D. Price
*Attorney, Agent, or Firm*—Collard & Roe, P.C.

[57] ABSTRACT

A gas burner for discharging a mixture of a gaseous fuel and combustion air into a combustion chamber wherein the mixture is burned and flue gases are formed comprises a burner body having a peripheral wall defining a combustion air supply passage having a central axis and having an orifice communicating with the combustion chamber. Primary gaseous fuel is injected in a central part of the combustion air supply passage, and secondary gaseous fuel is injected through pipes in the combustion air supply passage peripherally distributed about the primary gaseous fuel injection. Conduits for recycling the flue gases are disposed in the combustion air supply passage and associated with the secondary gaseous fuel injection. The secondary gaseous fuel is injected into the conduits, the conduits have an axis extending parallel to the central axis and an orifice along their axis at one end thereof, the orifice communicating with the combustion chamber. An end of the conduits opposite to the one end communicate with a portion of the combustion chamber surrounding the peripheral wall of the combustion air supply passage through openings in the peripheral wall, and a flame stabilizer is arranged at the orifice of the combustion air supply passage.

14 Claims, 3 Drawing Sheets

GAS BURNER WITH VERY SMALL NITROGEN OXIDE EMISSION

BACKGROUND OF THE INVENTION

1. Field of the Invention

The present invention relates to improvements in a gas burner for discharging a mixture of a gaseous fuel and combustion air into a combustion chamber wherein the mixture is burned and flue gases having very low emission of nitrogen oxide are formed. Such burners comprise a burner body having a peripheral wall and being adapted to be mounted in the orifice of a wall of a housing defining a combustion chamber of a furnace or a boiler. Means are disposed in a central part of the burner body for injecting primary gaseous fuel, and means for injecting secondary gaseous fuel are peripherally distributed about the means for injecting primary gaseous fuel.

2. Description of the Prior Art

To reduce the content of nitrogen oxides in the flue gases, it is known to reduce the content of free oxygen in the gaseous fuel flame to avoid too strong a combination of the oxygen with the nitrogen in the combustion air, and to limit the maximum temperature of the flame. To reduce the content of free oxygen in the flame, it has been suggested to recycle a portion of the flue gases generated in the combustion chamber to mix it with the combustion air. It is known to realize this recycling by means of gaseous fuel ejection systems associated with venturi-type intake conduits for the flue gases, which utilize the low pressure created by the ejection of the fuel gas.

It is also known that the maximum temperature of the gaseous fuel flames may be limited by staggering the combustion, that is, instead of presenting the totality of the combustible fuel and the combusting agent in a single zone, one proceeds in two stages: this may be done either by staggering the injection of the combusting agent without modifying the injection of the fuel, or by staggering the injection of the fuel without staggering that of the combustion agent.

It is an object of this invention to provide a gas burner which combines these two processes of recycling the flue gases, on the one hand, and staggering the supply of the fuel gas and the combustion air, on the other hand. Gas burners of this general type and using either process are disclosed, for example, in the following publications:

European patent application No. 511,878, published Nov. 4, 1992, describes a burner comprising a ring of bricks or refractory concrete, which extends the passage supplying combustion air, and channels are pierced into the ring through which the totality of the gaseous fuel is injected by nozzles, some of these channels being radially disposed with respect to the axis of the burner to create a zone of turbulence and mixture, and other channels being inclined or parallel to the burner axis to obtain a staggering of the combustion.

U.S. Pat. No. 5,238,395 also discloses a burner with a refractory burner tile pierced by channels. The central flame is produced by several nozzles injecting the primary gaseous fuel in the channels and leading into the furnace space tangentially to the interior surface of the tile to create a zone of turbulence and mixture of the gaseous fuel and combustion air, and nozzles injecting the secondary gaseous fuel at the exterior surface of the tile, which is frusto-conical.

U.S. Pat. No. 5,135,387 discloses a burner with a central ring of refractory material surrounding a nozzle supplying primary gaseous fuel, which is surrounded by a plurality of nozzles supplying secondary gaseous fuel, some of which create a mixing zone and are supplied with recycled flue gases through a conduit leading the flue gases towards these nozzles, which necessitates double walls in the furnace itself.

All the known burners require a refractory ring disposed about the discharge orifice of the burner. The injection nozzles for the secondary gaseous fuel or some of them are disposed at the periphery, and all of them are disposed in channels bored into the ring. In some of them, they are so oriented that they create a zone of turbulence and mixture in the interior of the ring where the main flame is formed. Such a refractory ring has several disadvantages: it is fragile and risks being destroyed or damaged by shocks; furthermore, dust or refractory pieces detached from the furnace wall may fall into the interior of the ring and partially block it, causing a deterioration of the combustion, which requires cleaning or even replacement of the ring and an interruption of the operation of the furnace or boiler equipped with such a burner. Since the fuel gas nozzles are disposed at the periphery of these known burners or in channels pierced in the refractory rings, they cannot be properly cooled, which may be another cause of deterioration.

SUMMARY OF THE INVENTION

It is a primary object of the invention to avoid these disadvantages and to develop a technology without a flame stabilizer constituted by a ring or sleeve of a fragile refractory material and such that the combustion zone is entirely outside the burner body and fully within the furnace chamber; to utilize the principle of staggering the combustion with separated elementary gaseous fuel flames supplied by means for injecting the gaseous fuels which may be cooled under the most favorable conditions; and to recycle the flue gases resulting from the combustion to reduce the content of free oxygen in the flames without the need of complex recycling conduits or special furnace walls.

The above and other objects are accomplished according to one aspect of the present invention with a gas burner for discharging a mixture of a gaseous fuel and combustion air into a combustion chamber wherein said mixture is burned and flue gases are formed, which comprises a burner body having a peripheral wall defining a combustion air supply passage having a central axis and having an orifice communicating with the combustion chamber. Means is disposed in a central part of the combustion air supply passage for injecting primary gaseous fuel, and means is disposed in the combustion air supply passage for injecting secondary gaseous fuel peripherally distributed about the means for injecting primary gaseous fuel. Conduits for recycling the flue gases are disposed in the combustion air supply passage and are associated with the means for injecting secondary gaseous fuel, the means for injecting secondary gaseous fuel being arranged to inject the secondary gaseous fuel into the conduits, the conduits having an axis extending parallel to the central axis and an orifice along said axis at one end thereof, the orifice communicating with the combustion chamber, and an end of the conduits opposite to the one end communicating with a portion of the combustion chamber surrounding the peripheral wall of the combustion air supply passage through openings in the peripheral wall. A flame stabilizer is arranged at the orifice of the combustion air supply passage.

According to another aspect of this invention, there is provided a method of using a gas burner for discharging a mixture of a gaseous fuel and combustion air into a combustion chamber wherein said mixture is burned and flue gases are formed. This method comprises the steps of supplying combustion air to the combustion chamber along a passage having a central axis through an orifice communicating with the combustion chamber, and injecting primary and secondary gaseous fuel along axes extending approximately parallel to the central axis, the injection of the secondary fuel being peripherally distributed about the injection of the primary gaseous fuel. The flue gases are recycled through conduits into which the secondary gaseous fuel is injected, a portion of the flue gases being received by orifices at one end of the conduits communicating with a portion of the combustion chamber peripherally surrounding the combustion air supply passage, and recycled through orifices at an end of the conduits opposite to the one end and communicating with the combustion chamber. A flame stabilizer is arranged at the orifice of the combustion air supply passage, and the orifices at the end of the conduits and the injection of the primary gaseous fuel are arranged close to the orifice of the passage for supplying combustion air and at a level with the flame stabilizer whereby a combustion zone is created externally of said passage by flames produced by the injected primary and secondary gaseous fuel.

It will be noted that this requires no refractory ring for creating and stabilizing a combustion zone situated at least partly in its center. Rather, the combustion zone is completely outside the burner proper, and this assures a much longer operating life for the components of the burner. This long operating life is further enhanced by the fact that the means for injecting secondary gaseous fuel are disposed in the passage supplying combustion air, which permits this means to be cooled. In addition, the aspiration of the flue gases from the combustion chamber for recycling them to reduce the presence of oxygen in the flames of the secondary gaseous fuel is effected by very simple and dependable means. No such means is situated in the combustion chamber or in the combustion zone because they are all in the interior of the burner body which defines the passage supplying combustion air.

By combining the two afore-mentioned means for reducing the production of nitrogen oxides, a good combustion mixture is obtained without creating a zone of turbulence, the content of nitrogen oxides in the flue gases being reduced by at least 70%.

BRIEF DESCRIPTION OF THE DRAWING

The above and other objects, advantages and features of the invention will become more apparent from the following description of certain now preferred embodiments thereof, taken in conjunction with the accompanying drawing wherein.

DETAILED DESCRIPTION OF THE PREFERRED EMBODIMENTS

Figure 1:
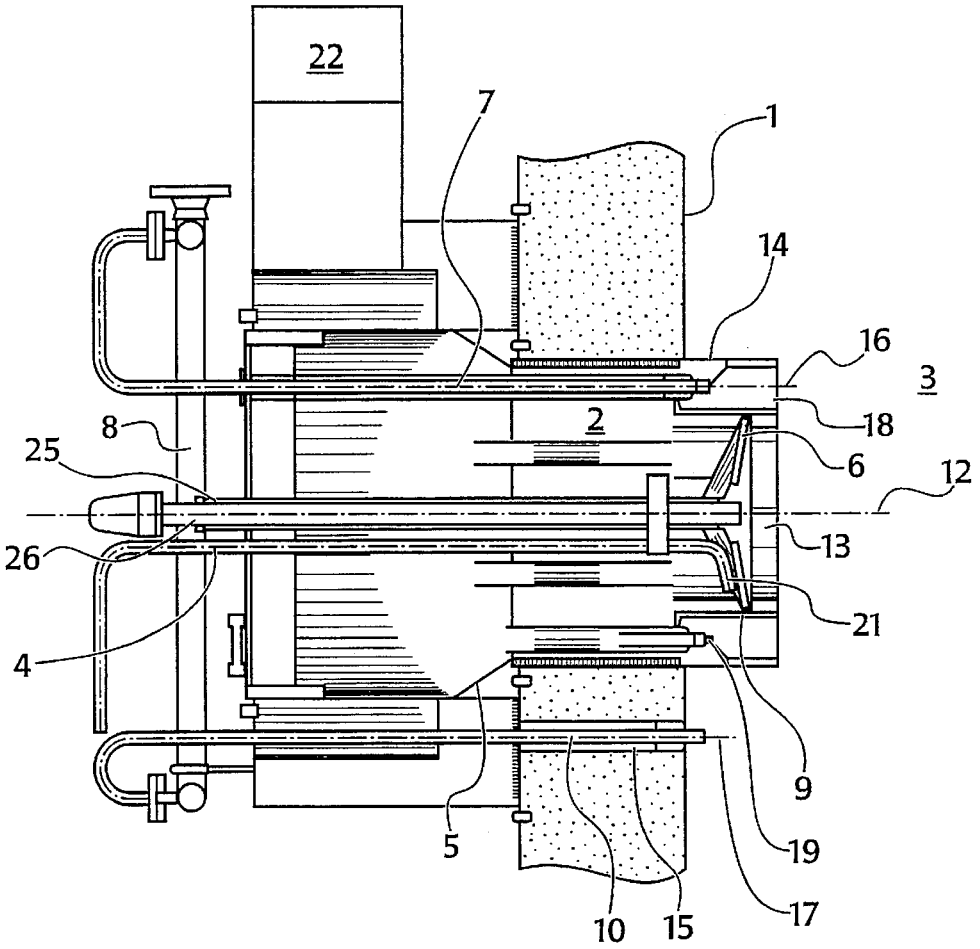
FIG. 1 is a cross section taken along line A—A of FIG. 2 of a gas burner according to one embodiment of the present invention, with pipes for injecting tertiary gaseous fuel whose axes extend parallel to a central axis of the burner body.
Figure 2:
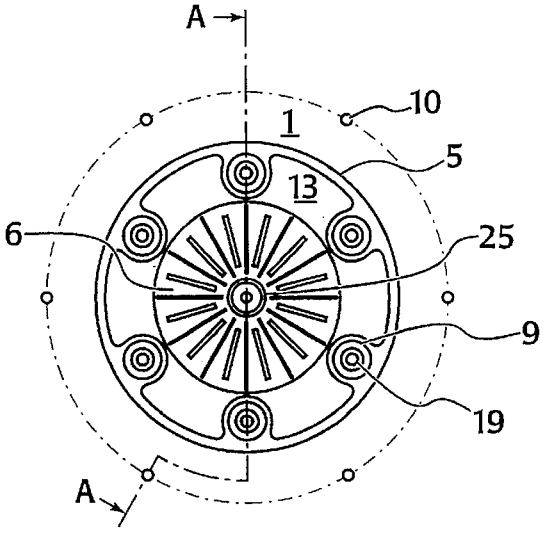
FIG. 2 is a front view of the burner, seen from the interior of the furnace of combustion chamber.

Referring now to the drawing and first to FIGS. 1 and 2, there is shown a gas burner for discharging a mixture of a gaseous fuel and combustion air into combustion chamber 3 of a furnace or boiler. The mixture is burned and flue gases are formed in the combustion chamber. The illustrated gas burner comprises a burner body having a peripheral wall 5 defining combustion air supply passage 2 having central axis 12 and orifice 13 communicating with combustion chamber 3. Any suitable source 22 of combustion air is provided outside of the burner body. The combustion air flows through passage 2 towards orifice 13 into combustion chamber 3. Means constituted by pipes 4 is disposed in a central part of combustion air supply passage 2 for injecting primary gaseous fuel, which forms flames at ends 21 of the pipes. In the illustrated embodiment, several pipes 4 are disposed about axis 12 in passage 2. Means constituted by pipes 7 is disposed in combustion air supply passage 2 for injecting secondary gaseous fuel and pipes 7 are peripherally distributed about means 4 for injecting primary gaseous fuel, as best shown in FIG. 2. Secondary gaseous fuel is supplied to pipes 7 through manifold 8.

Conduits 9 for recycling the flue gases are disposed in combustion air supply passage 2 and are associated with supply pipes 7 for injecting secondary gaseous fuel, and pipes 7 for injecting secondary gaseous fuel are arranged to inject the secondary gaseous fuel into conduits 9. The conduits have an axis 16 extending parallel to central axis 12 and a discharge orifice 18 along axis 16 at one end thereof. Orifice 18 communicates with combustion chamber 3, and an end of conduits 9 opposite to the one end communicates with a portion of combustion chamber 3 surrounding peripheral wall 5 of combustion air supply passage 2 through openings 14 in the peripheral wall.

Flame stabilizer 6 is arranged at orifice 13 of combustion air supply passage 2. The flame stabilizer is constituted by a conical disc provided with radial ribs and slits, and pipes 4 are lances whose discharge ends 21 are adjacent a rear face of the flame stabilizer and outwardly bent to extend approximately parallel to the rear face of the flame stabilizer. The discharge ends have holes through which the primary gaseous fuel is injected through the openings in flame stabilizer 6 into combustion chamber 3. According to the present invention, the entire assembly of means 7 injecting secondary gaseous fuel and associated recycling conduits 9 is mounted inside passage 2 supplying combustion air.

Flame stabilizer 6 is carried by tube 25 extending along central axis 12 of passage 2, and ignition torch 26 is mounted in tube 25. Instead of an ignition torch, a pilot or a pipe injecting a liquid fuel may be used.

In order to separate the flames of secondary gaseous fuel from each other to reduce the production of nitrogen oxide by staggering the combustion, pipes 7 and associated conduits 9 for recycling a portion of the flue gases are sufficiently spaced from each other as a function of the diameter of combustion air supply passage 2. Preferably, the means for injecting the secondary gaseous fuel comprises five to ten or eight pipes distributed regularly about the central axis and means 4 injecting primary gaseous fuel. Six pipes 7 and associated conduits 9 are shown in FIG. 2.

As shown in FIG. 1, combustion chamber 3 has an end wall 1 defining a plane, and the burner body projects from this plane into the combustion chamber, and openings 14 in peripheral wall 5 are arranged adjacent and downstream of the end wall plane.

The recycling conduit orifices 18 extend in a plane extending perpendicularly to the central axis at a discharge end of the combustion air supply passage, in which plane discharge orifice 13 of combustion air supply passage 2 is also located, the plane being disposed slightly downstream of flame stabilizer 6. Therefore, the flames produced by the combustion of the gaseous mixture are outside the burner body beyond flame stabilizer 6, thus creating a combustion zone outside the burner. The means 7 for injecting secondary gaseous fuel have discharge ends at which nozzles 19 are mounted, and these nozzles inside conduits 9 are at a level with the opposite ends of the recycling conduits and openings 14 in peripheral wall 5. The speed of ejection of the fuel from nozzles 19 creates a natural draft entraining the flue gases through openings 14 and discharge orifices 18. Recycling conduits 9 form excrescences in the interior of passage 2 and are effectively cooled by the combustion air circulating therethrough.

To enhance the combustion staggering, the illustrated burner further comprises means constituted by pipes 10 disposed outside combustion air supply passage 2 and peripherally distributed thereabout for injecting tertiary gaseous fuel. Pipes 10 pass through additional combustion air supply passages 15 in end wall 1 of the combustion chamber housing. Passages 15 surround the burner body and may receive combustion air from source 22. Pipes 10 are shown connected to manifold 8 feeding tertiary gaseous fuel.

Figure 1A:
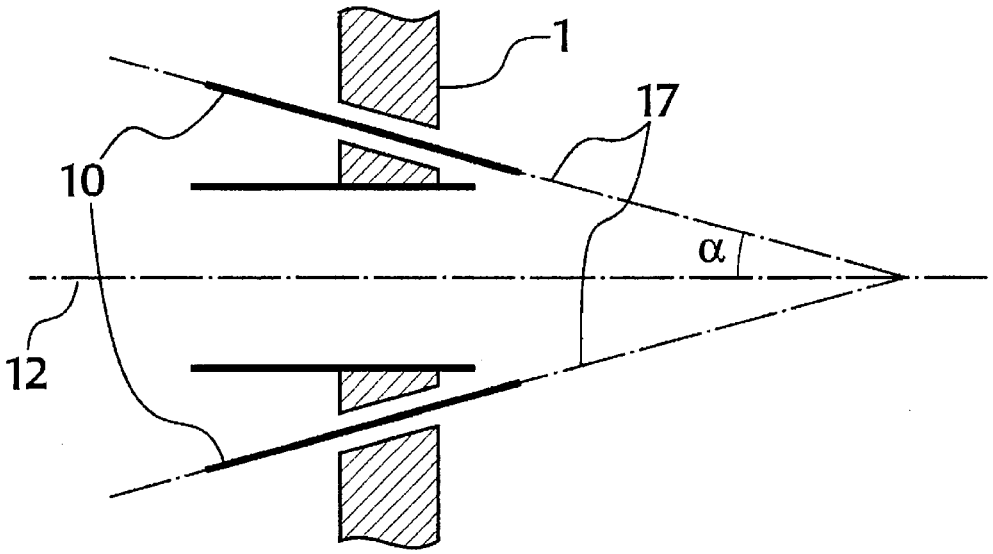
FIGS. 1*a* and 1*b* are fragmentary sectional views showing embodiments wherein the tertiary gaseous fuel injection pipes have axes defining a radial plane inclined with respect to the central axis.
Figure 1B:
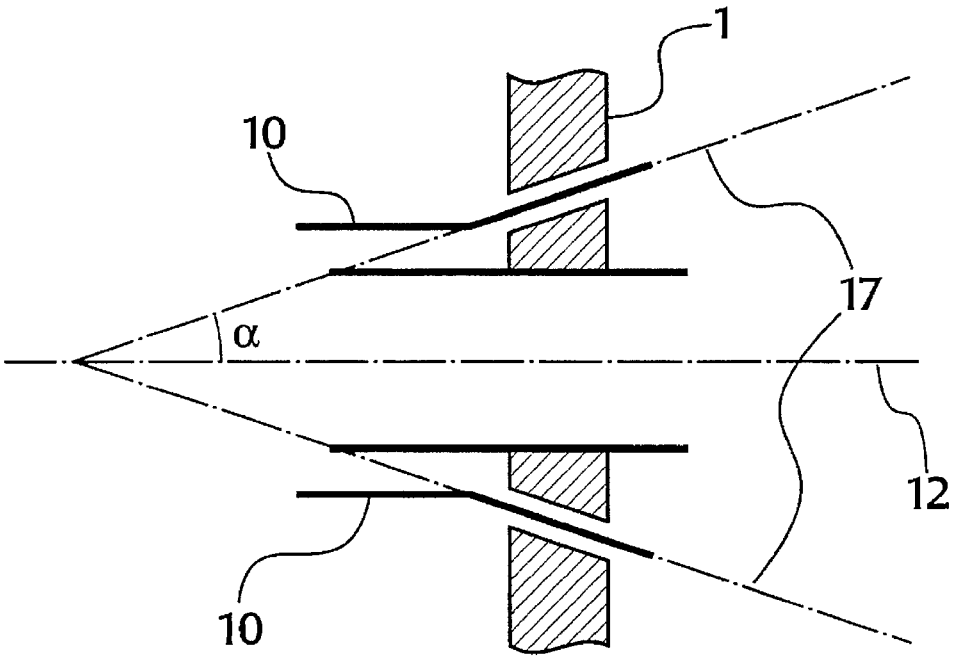

Each pipe for injecting tertiary gaseous fuel has an axis 17 defining a radial plane with central axis 12. Axes 17 and 12 enclose an angle of 0° to 40° α define a cone of revolution about the central axis having its apex in front of or at the rear of wall 1 of the combustion chamber. The number of pipe 10 injecting tertiary gaseous fuel may be equal to the number of pipes 7 injecting secondary gaseous fuel, for instance six, as shown in FIG. 2. As shown in FIG. 1, axis 17 of pipes 10 extends parallel to central axis 12 while FIGS. 1*a* and 1*b* show axes 17 defining radial planes with central axis 12 which are inclined at an angle α not exceeding 40° with respect to the central axis.

Figure 3:
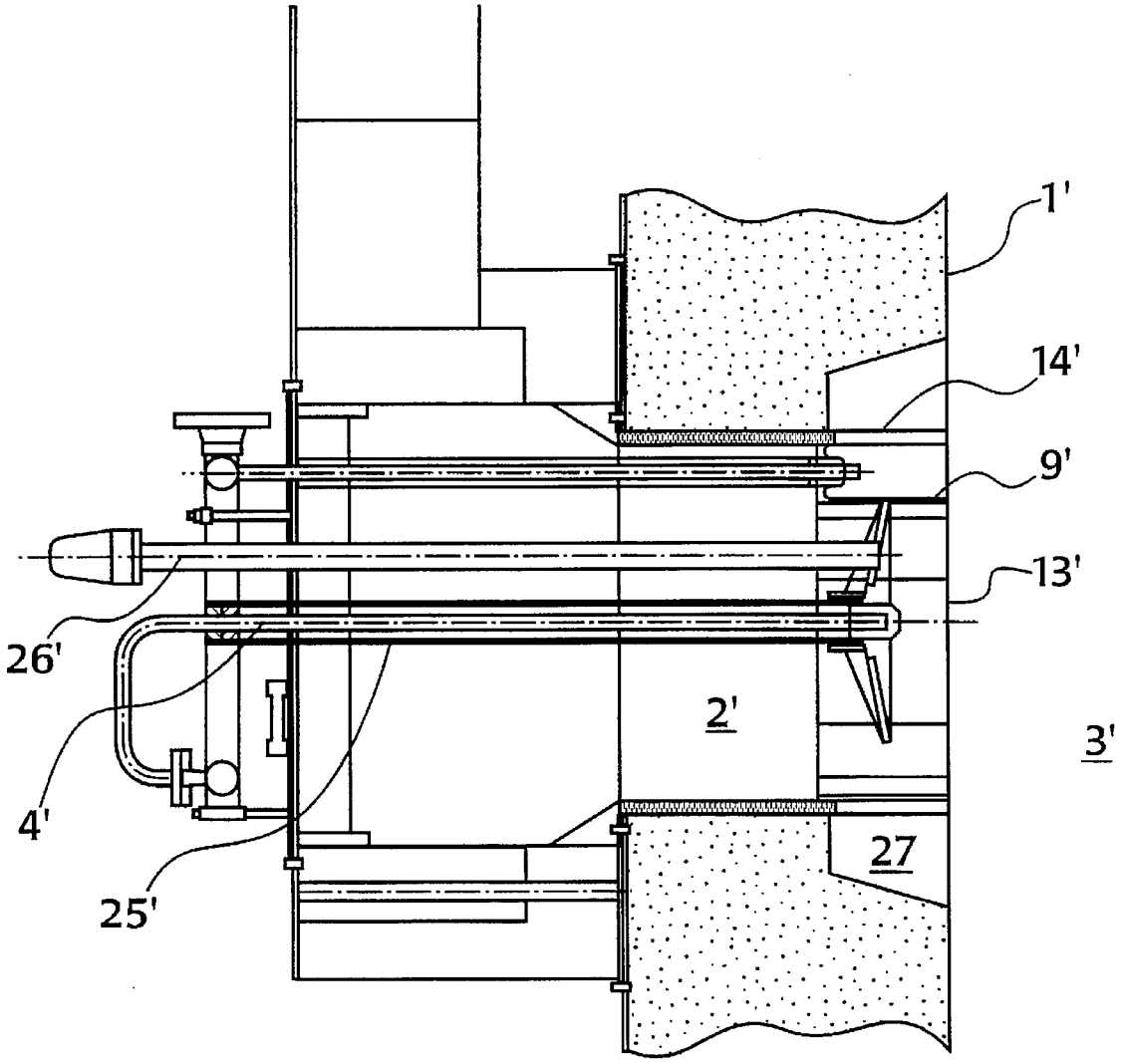
FIG. 3 is a view similar to that of FIG. 1, showing a modified embodiment.

In the embodiment of FIG. 3, wherein like, but primed, reference numerals indicate like parts operating in a like manner, combustion chamber end wall 1' defines a first plane, and end wall 1' has recessed portion 27 surrounding a projecting end of the burner body and defining a second plane. Orifice 13' of combustion air supply passage 2' extends in the first plane, and the burner body projects from the second plane into combustion chamber 3'. Openings 14' in the peripheral wall are arranged adjacent and downstream of the second end wall plane in recessed end wall portion 27 to permit the aspiration of the flue gases into conduits 9'.

Furthermore, only a single pipe 4' injecting the primary gaseous fuel is provided in this embodiment and this pipe is disposed in tube 25' extending along the central axis of passage 2'. Pipe 4' terminates in a nozzle which has several peripherally spaced discharge orifices adjacent the front face of the flame stabilizer. Ignition torch 26' is disposed eccentrically in passages 2'.

The illustrated gas burner is operated in the following manner according to the present invention:

Combustion air is supplied to combustion chamber 2 along passage 2 having central axis 12 through orifice 13 communicating with the combustion chamber. Primary and secondary gaseous fuel is injected along axes extending approximately parallel to the central axis, the injection of the secondary fuel being peripherally distributed about the injection of the primary gaseous fuel. Flue gases are recycled through conduits 9 into which the secondary gaseous fuel is injected, a portion of the flue gases being received by orifices 14 at one end of conduits 9 communicating with a portion of combustion chamber 3 peripherally surrounding passage 2 supplying combustion air, and recycled through orifices 18 of the conduits opposite to the one end communicating with a portion of the combustion chamber peripherally surrounding the combustion air supply passage. Flame stabilizer 6 is arranged at discharge orifice 13 of combustion air supply passage 2, and orifices 18 of conduits 9 and discharge ends 21 of the injection of the primary gaseous fuel are disposed close to orifice 13 of passage 2 for supplying combustion air and at a level with the flame stabilizer whereby a combustion zone is created externally of passage 2 by flames produced by the injected primary and secondary gaseous fuel.

As shown, the secondary gaseous fuel is injected along separate paths so spaced from each other that clearly separated flames of secondary gaseous fuel are created. Furthermore, tertiary gaseous fuel may be injected outside combustion air supply passage 2 and peripherally distributed thereabout. Combustion air may be supplied through additional passages 15, the injection of the tertiary gaseous fuel passing through the additional combustion air supply passages.

The supply of combustion air, the injection of the primary and secondary gaseous fuel, and the flame stabilizer are assembled in a manner to prevent any turbulence of the combustion air and the gaseous fuel injections.

What is claimed is:

1. A gas burner for discharging a mixture of a gaseous fuel and combustion air into a combustion chamber wherein said mixture is burned and flue gases are formed, which comprises (a) a burner body having a peripheral wall defining a combustion air supply passage having a central axis and projecting into the combustion chamber, said peripheral wall defining an orifice communicating with the combustion chamber, (b) means disposed in a central part of the combustion air supply passage of the burner body for injecting primary gaseous fuel, (c) means disposed inside the combustion air supply passage of the burner body for injecting secondary gaseous fuel peripherally distributed about the means for injecting primary gaseous fuel, (d) conduits for recycling the flue gases extending inwardly of the peripheral wall, the conduits being disposed within the combustion air supply passage of the burner body and associated with the means for injecting secondary gaseous fuel, (1) the means for injecting secondary gaseous fuel being arranged to inject the secondary gaseous fuel into the conduits, (2) each one of the conduits having an axis extending parallel to the central axis and an orifice arranged along said axis and at one end of each of the conduits, the orifice communicating with the combustion chamber, and (3) an end of the conduits, opposite to the one end, communicating with a portion of the combustion chamber in an area surrounding the peripheral wall of the burner body, through openings in the peripheral wall, and (e) a flame stabilizer arranged within the orifice of the combustion air supply passage.

2. The gas burner of claim 1, wherein the means for injecting the secondary gaseous fuel comprises five to eight pipes distributed regularly about the central axis.

3. The gas burner of claim 1, wherein the furnace chamber has an end wall defining a plane, the burner body projecting from said plane into the combustion chamber, and the openings in the peripheral wall are arranged adjacent and downstream of the end wall plane.

4. The gas burner of claim 1, wherein the combustion chamber has an end wall defining a first plane, and the end wall has a recessed portion defining a second plane, the orifice of the combustion air supply passage extends in the first plane, the burner body projecting from the second plane into the combustion chamber, and the openings in the peripheral wall are arranged adjacent and downstream of the second end wall plane.

5. The gas burner of claim 1, wherein the recycling conduit orifices extend in a plane extending perpendicularly to the central axis at a discharge end of the combustion air supply passage, and the means for injecting secondary gaseous fuel have discharge ends at a level with the opposite ends of the recycling conduits.

6. The gas burner of claim 1, further comprising means disposed outside the combustion air supply passage and peripherally distributed thereabout for injecting tertiary gaseous fuel.

7. The gas burner of claim 6, wherein said means for injecting tertiary gaseous fuel comprises a plurality of pipes peripherally distributed about the burner body, each pipe having an axis defining a radial plane with the central axis and inclined at an angle not exceeding 40° with respect to the central axis.

8. A method of operating a gas burner for discharging a mixture of a gaseous fuel and combustion air into a combustion chamber wherein said mixture is burned and flue gases are formed, which comprises the steps of (a) supplying combustion air to the combustion chamber along a passage having a central axis through a discharge orifice communicating with the combustion chamber, (b) injecting primary and secondary gaseous fuel inside said passage along axes extending approximately parallel to the central axis, the injection of the secondary gaseous fuel being peripherally distributed about the injection of the primary gaseous fuel, (c) recycling the flue gases exclusively through conduits disposed within said passage into which the secondary gaseous fuel is injected, (1) a portion of the flue gases being received by orifices at one end of the conduits communicating with a portion of the combustion chamber peripherally surrounding the combustion air supply passage, and recycled through orifices at an end of the conduits opposite to the one end and communicating with the combustion chamber, (d) arranging a flame stabilizer within the orifice of the combustion air supply passage, and (e) disposing the orifices at the end of the conduits opposite the one end and the injection of the primary gaseous fuel close to the orifice of the passage for supplying combustion air and at a level with the flame stabilizer whereby a combustion zone is created externally of said passage by flames produced by the injected primary and secondary gaseous fuel.

9. The method of claim 8, wherein the secondary gaseous fuel is injected along separate paths so spaced from each other that clearly separated flames of secondary gaseous fuel are created.

10. The method of claim 8, further comprising the step of injecting tertiary gaseous fuel outside the combustion air supply passage and peripherally distributed thereabout.

11. A gas burner for discharging a mixture of a gaseous fuel and combustion air into a combustion chamber wherein said mixture is burned and flue gases are formed, which comprises (a) a burner body having a peripheral wall defining a combustion air supply passage having a central axis and projecting into the combustion chamber, said peripheral wall defining a burner body orifice communicating with the combustion chamber, (b) primary gaseous fuel lances disposed in a central part of the burner body and having discharge ends for injecting primary gaseous fuel, (c) secondary gaseous fuel lances having discharge ends for injecting secondary gaseous fuel peripherally distributed about the primary gaseous fuel lances, (d) conduits for recycling the flue gases, the conduits being disposed inside the combustion air supply passage of the burner body and associated with the secondary gaseous fuel lances having discharge ends for injecting secondary gaseous fuel, (1) the secondary gaseous fuel lances having discharge ends for injecting secondary gaseous fuel being arranged to inject the secondary gaseous fuel into the conduits, (2) each one of the conduits having an axis extending parallel to the central axis and a conduit orifice along said axis and at one end of each one of the conduits, the conduit orifice communicating with the combustion chamber through the burner body orifice, and (3) an end of each one of the conduits, opposite to the one end, communicating with a portion of the combustion chamber in the area surrounding the peripheral wall of the burner body through openings in the peripheral wall, and (e) a flame stabilizer arranged in the orifice of the combustion air supply passage, the flame stabilizer defining openings and a rear face adjacent the discharge ends of the primary gaseous fuel lances for injecting primary gaseous fuel, and the discharge ends for injecting primary gaseous fuel being bent to extend approximately parallel to the rear face of the flame stabilizer.

12. A gas burner for discharging a mixture of a gaseous fuel and combustion air into a combustion chamber wherein said mixture is burned and flue gases are formed, which comprises (a) a burner body having a peripheral wall defining a combustion air supply passage having a central axis and projecting into the combustion chamber, said peripheral wall defining a burner body orifice communicating with the combustion chamber, (b) means disposed in a central part of the combustion air supply passage of the burner body for injecting primary gaseous fuel;

(c) means disposed inside the combustion air supply passage of the burner body for injecting secondary gaseous fuel peripherally distributed about the means for injecting primary gaseous fuel, (d) means disposed outside the burner body and peripherally distributed thereabout for injecting tertiary gaseous fuel, (e) additional combustion air supply passages, the means for injecting tertiary gaseous fuel passing through the additional combustion air supply passages, (f) conduits for recycling the flue gases extending inwardly of the peripheral wall, the conduits being disposed within the combustion air supply passage of the burner body and associated with the means for injecting secondary gaseous fuel, (1) the means for injecting secondary gaseous fuel being arranged to inject the secondary gaseous fuel into the conduits, (2) each one of the conduits having an axis extending parallel to the central axis and an orifice arranged along said axis and at one end of each one of the conduits, the orifice communicating with the combustion chamber, and (3) an end of the conduits opposite to the one end, communicating with a portion of the combustion chamber in an area surrounding the peripheral wall of the burner body, through openings in the peripheral wall, and (g) a flame stabilizer arranged within the orifice of the combustion air supply passage.

13. A method of operating a gas burner for discharging a mixture of a gaseous fuel and combustion air into a combustion chamber wherein said mixture is burned and flue gases are formed, which comprises the steps of (a) supplying combustion air to the combustion chamber along a passage having a central axis through a discharge orifice communicating with the combustion chamber, (b) injecting primary and secondary gaseous fuel inside said passage along axes extending approximately parallel to the central axis, the injection of the secondary gaseous fuel being peripherally distributed about the injection of the primary gaseous fuel, (c) injecting tertiary gaseous fuel outside the combustion supply passage and peripherally distributed thereabout, (d) supplying combustion air through additional passages, the injection of the tertiary gaseous fuel passing through the additional combustion air supply passages, (e) recycling the flue gases exclusively through conduits disposed within said passage into which the secondary gaseous fuel is injected, (1) a portion of the flue gases being received by orifices at one end of the conduits communicating with a portion of the combustion chamber peripherally surrounding the combustion air supply passage, and recycled through orifices at an end of the conduits opposite to the one end and communicating with the combustion chamber, (f) arranging a flame stabilizer within the orifice of the combustion air supply passage, and (g) disposing the orifices at the end of the conduits opposite the one end and the injection of the primary gaseous fuel close to the orifice of the passage for supplying combustion air and at a level with the flame stabilizer whereby a combustion zone is created externally of said passage by flames produced by the injected primary and secondary gaseous fuel.

14. A method of operating a gas burner for discharging a mixture of a gaseous fuel and combustion air into a combustion chamber wherein said mixture is burned and flue gases are formed, which comprises the steps of (a) supplying combustion air to the combustion chamber along a passage having a central axis through a discharge orifice communicating with the combustion chamber, (b) injecting primary and secondary gaseous fuel inside said passage along axes extending approximately parallel to the central axis, the injection of the secondary gaseous fuel being peripherally distributed about the injection of the primary gaseous fuel, (c) recycling the flue gases exclusively through conduits disposed within said passage into which the secondary gaseous fuel is injected, (1) a portion of the flue gases being received by orifices at one end of the conduits communicating with a portion of the combustion chamber peripherally surrounding the combustion air supply passage, and recycled through orifices at an end of the conduits opposite to the one end and communicating with the combustion chamber, (d) arranging a flame stabilizer within the orifice of the combustion air supply passage, (e) disposing the orifices at the end of the conduits opposite the one end and the injection of the primary gaseous fuel close to the orifice of the passage for supplying combustion air and at a level with the flame stabilizer whereby a combustion zone is created externally of said passage by flames produced by the injected primary and secondary gaseous fuel, and (f) assembling the supply of combustion air, the injection of the primary and secondary gaseous fuel, and the flame stabilizer in a manner to prevent any turbulence of the combustion air and the gaseous fuel injections.

* * * * *